US010256010B2

(12) United States Patent
McFarland et al.

(10) Patent No.: US 10,256,010 B2
(45) **Date of Patent: *Apr. 9, 2019**

(54) DOWNHOLE RUNNING CABLE HAVING NON-METALLIC CONDUCTING AND LOAD BEARING WIRE

(71) Applicant: Weatherford Technology Holdings, LLC, Houston, TX (US)

(72) Inventors: Bradley J. McFarland, Houston, TX (US); Andrew J. Baker, Houston, TX (US); George J. Rodger, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/313,056

(22) PCT Filed: Jun. 5, 2015

(86) PCT No.: PCT/US2015/034446

§ 371 (c)(1),
(2) Date: Nov. 21, 2016

(87) PCT Pub. No.: WO2015/188083

PCT Pub. Date: Dec. 10, 2015

(65) Prior Publication Data

US 2017/0186512 A1 Jun. 29, 2017

Related U.S. Application Data

(60) Provisional application No. 62/008,165, filed on Jun. 5, 2014.

(51) Int. Cl.
*E21B 47/00* (2012.01)
*H01B 7/00* (2006.01)
(Continued)

(52) U.S. Cl.
CPC ..... *H01B 7/046* (2013.01); *E21B 17/028* (2013.01); *E21B 19/08* (2013.01); *E21B 23/14* (2013.01);
(Continued)

(58) Field of Classification Search
CPC ..... H01B 7/0009; E21B 47/01; E21B 19/084; E21B 19/08; E21B 47/09; E21B 47/04;
(Continued)

(56) References Cited

U.S. PATENT DOCUMENTS 1,993,526 A * 3/1935 Rihl ..... H01B 7/14 174/105 B
3,493,043 A 2/1970 Watkins
(Continued)

FOREIGN PATENT DOCUMENTS

WO 2012/009286 A1 1/2012
WO WO 2013/098280 * 7/2013

OTHER PUBLICATIONS

Int'l Search Report in counterpart PCT Appl. PCT/US2015/034446, dated Oct. 27, 2015, 5-pgs.
(Continued)

*Primary Examiner* — Chau N Nguyen
(74) *Attorney, Agent, or Firm* — Blank Rome LLP

(57) ABSTRACT

A cable (100) is used for running a load between surface and downhole in a well. The cable includes one or more wires (110) composed of a non-metallic material. Each of the one or more wires (110) bears the load from the surface and electrically conducts between the surface and downhole. An insulating material (120) is disposed about the one or more wires (110) and insulates the electrical conduction. The non-metallic material includes a carbon nano-tube wire. A jacket (130) can be disposed about the insulating material
(Continued)

(120), and the jacket (130) can be composed of a non-metallic material also, such as carbon nano-tube wire.

38 Claims, 10 Drawing Sheets

(51) Int. Cl.

| | |
|---|---|
| ***H01B 7/04*** | (2006.01) |
| ***E21B 23/14*** | (2006.01) |
| ***E21B 47/12*** | (2012.01) |
| ***E21B 17/02*** | (2006.01) |
| ***E21B 19/08*** | (2006.01) |
| ***H01B 1/18*** | (2006.01) |
| ***H01B 7/18*** | (2006.01) |

(52) U.S. Cl.
CPC ..... *E21B 47/122* (2013.01); *H01B 1/18* (2013.01); *H01B 7/18* (2013.01); *E21B 47/12* (2013.01); *H01B 7/04* (2013.01)

(58) Field of Classification Search
CPC ..... E21B 17/20; E21B 19/008; E21B 47/12; G01D 5/02; G01D 5/26
USPC ..... 174/107, 126.1, 126.2
See application file for complete search history.

(56) References Cited

U.S. PATENT DOCUMENTS

| | | | | |
|---|---|---|---|---|
| 5,367,971 | A * | 11/1994 | Carpenter | G01V 1/201 114/243 |
| 7,699,114 | B2 * | 4/2010 | Ullah | G01V 11/002 166/385 |
| 7,737,358 | B2 * | 6/2010 | Hopkinson | H01B 11/04 174/113 R |
| 9,488,044 | B2 * | 11/2016 | Prange | E21B 47/00 |
| 2004/0020681 | A1 * | 2/2004 | Hjortstam | B82Y 30/00 174/102 SC |
| 2009/0260804 | A1 | 10/2009 | Mydur et al. | |
| 2010/0000754 | A1 * | 1/2010 | Mann | H01B 1/04 174/34 |
| 2011/0297397 | A1 * | 12/2011 | Morrison | E21B 17/20 166/382 |
| 2012/0125656 | A1 * | 5/2012 | Wei | B82Y 30/00 174/103 |
| 2012/0267141 | A1 | 10/2012 | Kamiyama et al. | |
| 2014/0127053 | A1 | 5/2014 | Sheth | |
| 2015/0009041 | A1 * | 1/2015 | van der Ende | E21B 47/122 340/854.9 |
| 2015/0354351 | A1 * | 12/2015 | Morrow | E21B 47/01 367/82 |
| 2016/0091622 | A1 * | 3/2016 | Pei | G01V 1/28 702/11 |

OTHER PUBLICATIONS

Written Opinion in counterpart PCT Appl. PCT/US2015/034446, dated Oct. 27, 2015, 7-pgs.

* cited by examiner

DOWNHOLE RUNNING CABLE HAVING NON-METALLIC CONDUCTING AND LOAD BEARING WIRE

BACKGROUND OF THE DISCLOSURE

Downhole running cables are used in the oil and gas industry for deploying and retrieving well intervention and logging equipment in a well. For example, tools can be deployed downhole using a slickline spooled out from a drum and guided over sheaves before entering the well. Steel wires are generally chosen for such services to meet the rigorous physical requirements of the service while maintaining tensile strength without sustaining damage. However, if the deployed tool relies on electrical signals, steel wires are not typically used to for communicating the electrical signals. Instead, copper conductors are used for this purpose. Since the copper cannot sustain load, the cable is reinforced with steel wire.

FIG. 1 illustrates a typical rig up system 10 for running cable 12 downhole for various purposes. The system 10 is shown for slickline, but the rig up for wireline (e-line), braided line, Heavy Duty Wireline Fishing (HDWF) line, and the like may use the same general configuration. The difference is that wireline (e-line), braided line, and HDWF line use a grease injection system to maintain well pressure. As shown, slickline instead uses a stuffing box 32.

The cable 12 (e.g., slickline, braided wireline, electric line, etc.) passes from a drum 22 in a deployment unit 20 to a hay pulley 28, which directs the cable 12 to the sheave on the stuffing box 32. The cable 12 enters the stuffing box 32, passes through a chemical injection sub 34, and a lubricator 36, and passes to a secondary barrier 38 or blow out preventer. Eventually, the cable 12 passes to the Christmas tree 40 through the swab and master valves 42, and then to the well for its intended purposes. Various other components are used with the system as well, but are not described here. When the cable 12 is used for intervention, for example, the rig up system 10 may include cable cutter subs, a tool trap, a tool catcher, check valves, etc.

The stuffing box 32 packs off around the cable 12. The chemical injection sub 34 applies various agents and corrosion inhibitors to the cable 12 during operations. The lubricator 36 is used for inserting and retrieving a tool string (not shown) when the well is under pressure. The secondary barrier 38 can use ram seals to close off around the cable 12 in the event of an emergency or essential maintenance.

For those cables 12 with a smooth outer surface, the stuffing box 32 can use elastomeric seals. Otherwise, grease-injected sealing hardware is used with served or braided cable surfaces. Where a stuffing box 32 cannot be used, for example, a grease injection control head (not shown) can create a seal around the moving cable 12 by injecting grease so the cable 12 can be run for intervention operations in wells under pressure.

The rig up's deployment unit 20 can be skid mounted on the rig or can be part of a deployment truck. The unit 20 stores the cable 12 on the drum 24 that feeds the cable 12 on and off of the unit 20. A winch for the drum 24 has a hydraulic drive powered by a diesel engine or electric power pack that drives the drum 24 to feed or pull the cable 12. The unit 20 may also include depth and tension systems. For example, a weight indicator sensor 29 can be used to measure line tension on the cable 12, and a depth counter 26 can be used to measure the length of cable 12.

As an example, FIG. 2 schematically shows a measuring device 50 that can measure depth and tension for the deployment unit (20). This measuring device 50 uses two wheels 52, 54 to measure depth of the cable 12. The device 50 mounts in front of the drum (24) on a spooling mechanism and can ride back and forth on linear bearings. The cable 12 from the drum (24) completely wraps around both wheels 52, 54 and extends from the wheels 52, 54 to other components to go to the well. Spooling rollers 55, guide rollers 56, and a pressure wheel 58 keep the cable 12 in the wheels 52, 54 and assist in spooling of the cable 12. Line tension is measured from a load pin axle 53 for the tension wheel 52. A hydraulic load cell may also be included that measures cable tension independently of the electronic load pin. Depth information is provided by an encoder 57 to the unit's control panel (22), which accounts for the size and stretch of the cable 12.

The cable 12 can come in various arrangements and geometries. Some forms of downhole running cables, such as wirelines, e-lines, braided lines, etc., have wires or strands. For example, FIG. 3A illustrates a cross-sectional view of a cable 60*a* according to the prior art. This cable 60*a* is a Dyform® Well Service strand available from BRIDON International Ltd. (DYFORM is a registered trademark of BRIDON PLC COMPANY.) The cable 60*a* includes nine outer strands 66, nine intermediate strands 64, and one inner strand 62. The outer strands 66 are indented to provide a smooth external periphery to reduce pressure leakage when running the cable 60*a*. Other than the 1×19 arrangement shown, the cable 60*a* can also come in a 1×16 conventional arrangement.

FIG. 3B illustrates a cross-sectional view of a mono-core cased hole cable 60*b*. The cable 60*b* has armor wires 64 disposed about an inner core wire 62. Typical sizes for the cable 60*b* are from 3/16 to ½-in. The armor wires 64 are the load bearing components of the cable 60*b*, and the inner core wire 62 is the conductor. The inner core wire 62 as the conductor is composed of copper wire and has shielding 65 around it. The armor wires 64 as the load bearing members are typically composed of steel and are not used as conductors. In some instances, a plastic sheath (not shown) may be disposed around the outside of the armor wires 64, but this is not strictly necessary.

Other forms of downhole running cables, such as slickline cables, used in the oilfield industry typically have metallic tubes that hold insulated copper conductors. The metallic tubes are typically made of Iconel® or other non-corrosive material. (INCONEL is a registered trademark of HUNTINGTON ALLOYS CORPORATION.) In many cases, the metallic tubes lack strength, and this prevents the slickline cables from being used with much pull force. Additionally, the slickline cables having the metallic tubes may need to pass through relatively small sheaves (16 to 20 in. in diameter) so the slickline cables may be prone to yielding and failure as they pass over the sheaves.

FIG. 3C illustrates a cross-sectional view of a conventional slickline cable 60*c* according to the prior art as described in U.S. Pat. No. 8,000,572. The cable 60*c* has a smooth outer surface so it can be used with a stuffing box and does not need a grease injection system. In cases where the cable 60*c* needs to effectively conduct electrical signals, the cable 60*a* typically has a copper wire core 72 for the cable's electrical conductors. The core 72 may instead have optical fiber conductors. Either way, the core 72 of copper wire or optical fiber lacks sufficient strength to carry tensile loads to which the cable 60*c* is subjected. Therefore, an outer metal tube 70 is used as the load-bearing member for the cable 60*c* and can surround the electrically conductive core 72 and any insulating layers.

For example, one such conductive slickline cable 60*c* has a solid copper wire core 72, an insulating jacket 74, and a serve of copper wires 76 on the outer diameter of the insulating jacket 74. A 316L stainless steel tube 70 is formed, welded, and drawn over the core 72, insulating jacket 74, and serve wires 76 to form a snug fit. The insulating jacket 74 can be composed of TEFLON (polytetrafluoroethylene and perfluoroalkox polymers and a trademark of E. I. du Pont de Nemours and Company of Wilmington, Del., U.S.A.). The tensile strength and fatigue life for this cable 60*c* are governed by the stainless steel tube 70 because the copper core 72 adds little strength.

In another arrangement, the slickline 60*c* uses an epoxy/fiber composite 76 sandwiched between two steel tubes 70 and 74 with optical fibers or copper conductors 72 contained in the inside tube 74. As shown in FIG. 3C, the fibers or conductors 72 are placed in the central metallic tube 74, which can be composed of stainless steel. Epoxy/long fiber composite 76 is then pultruded over the tube 74, and an outer tube 70 is generally placed over the composite 76. In this construction, the composite 76 provides a lightweight strength as well as a hydrogen-resistant barrier.

FIG. 3D illustrates a cross-sectional view of a coated slickline 60*d* according to the prior art. The slickline 60*d* has a standard slickline core 73, composed of stainless steel, surrounded by a polymer coating 77. One particular example of this type of slickline 60*d* is LIVE digital slickline available from Schlumberger Limited. The digital slickline 60*d* has an integral coating for digital two-way communication. A standard slickline unit and pressure control equipment deploy the slickline, and sensors downhole measure tension, detect shock and well deviation, and monitor temperature.

FIG. 3E illustrates a cross-sectional view of another prior art conductive slickline 60*e* for oilfield use, as described in U.S. Pat. No. 6,960,724. The cable 60*e* has a solid copper core conductor 72, a surrounding electrically insulating layer 74, and a tubular outer cover 76, which can be formed of a metal alloy. The core conductor 72 is electrically conductive, but lacks sufficient tensile strength to serve as a stress member for the cable 60*e*. Therefore, the outer cover 76 serves as the only stress member.

In some cables, the stress member of the outer cover 76 can be a solid component, such as a wire, rod, or tube. In other cables, the stress member of the outer cover 76 are formed of helically served wires, which are typically wrapped in two layers at similar angles, but in opposite directions. Together, the layers of wrapped wires serve as the stress member 76. The cable stress member 76 may also be braided, and may be fabricated from synthetic fibers, such as Kevlar (trademark of E. I. du Pont de Nemours and Company of Wilmington, Del., U.S.A.) or polyester.

In FIG. 3F, an electrical cable 60*f* such as disclosed in U.S. Pat. No. 6,960,724 has a solid core conductor 72, a surrounding electrically insulating layer 74, and a conductive tubular metal outer cover 76. Here, the core conductor 72 is a steel wire so that it is electrically conductive and has sufficient tensile strength to serve as an additional stress member for the cable 60*f*. The core conductor 72 and the outer cover 76 may, alternatively, be of braided wire construction. Thus, the cable 60*f* can have dual stress members, including the core conductor 72 and the outer cover 76, which are both electrically conductive.

To enhance its electrical conductivity, the core conductor 72 may be coated in copper or other highly electrically conductive material. Alternatively, a serve of copper wires 73 or copper tape may be applied to the surface of the core conductor 72 to increase its conductivity. The core conductor 72 may also be constructed of other electrically conductive materials that have the requisite tensile strength to act as a stress member, such as, aluminum or titanium, and, if of braided wire construction, may include a limited number of low tensile strength wire conductors, such as brass and copper. In yet a further alternative embodiment, the load-bearing core 72 may be constructed of a non-conductive carbon, glass, or synthetic fiber-reinforced plastic, with core conductivity provided by a copper or other highly conductive coating thereon.

The tubular metal outer cover 76 forms the second stress member of the cable 60*f* and also serves as the electrical return path. The outer cover 76 may be formed of any metal having suitable tensile strength and electrical conductivity, such as, for example, Inconel, stainless steel, galvanized steel, or titanium.

The dual stress members/conductors 72 and 76 are separated by electrically insulating layer 74, which is formed of a non-conductive material, such as TEFLON (polytetrafluoroethylene and perfluoroalkoxy polymers) or polyetheretherketone (PEEK). To enhance the electrical conductivity of the current path formed by the outer cover 76, the outer surface of the insulating layer 74 may be covered in a conductive material. This conductive material may be in the form of a coating, such as thermally sprayed copper, a conductive tape, or helically served wires 75.

In another prior art configuration, FIG. 3G shows a slickline cable 60*g* having of a solid wire core 72, an inner coating or jacket 74, and an outer coating or jacket 76. The outer coating 76 is resistant to abrasions and is smooth to allow easy travel through a packing assembly and blow-out preventer of the rig up assembly. The inner coating 74 can be heat resistant, and one or both of the coatings 74, 76 can be good insulators.

The outer coating 76 can be an epoxy, and the inner coating 74 can be a polyolephine. The outer coating 76 can be similar to the coating that is typically used on transformer windings with enhanced heat resistance and smoothness.

As shown in FIG. 3H, a slickline cable 60*h* of the prior art can include a conductive shield 78 between the inner coating 74 and the other coating 76. The conductive shield 78 acts as the return path.

As shown in FIG. 3I, the slickline cable 60*i* includes a hard jacketed cable. The hard jacketed cable 60*i* can include three parts of an outer tube 76, an insulating layer 74, and one or more conductors 72. The outer tube 76 is made of steel, such as a stainless steel similar to those used in a standard slickline cable. The thickness of the outer tube 76 is selected (a) to provide the strength necessary to pull and hold a tool and the cable 60*i* itself over the entire distance and depth that the tool is expected to operate in a borehole and/or (b) to be flexible enough to maneuver through the borehole or at least that portion of the borehole to be surveyed by the slickline tool.

The insulating layer 74 is a high temperature insulator that helps maintain the form of the outer tube 76. For example, the insulating layer 74 can include a magnesium oxide. The one or more conductors 72 can be copper wire and can be solid or stranded wire. The outer tube 76 acts as the return path and one or more of the conductors 72 acts as the forward path, or the reverse can be used. Alternatively, the conductors 72 can be used to provide power to a downhole tool.

As noted above, the cables can come in a variety of materials. The cable, such as the strands in FIG. 3A, can be composed of galvanized steel or 316 stainless steel depending of the well environment. Wirelines can be composed of plain carbon steel (API 9A), UHT carbon steel, and 316 stainless steel. Conductors for the cables can be composed of copper.

During use, the cables are subject to elastic elongation, permanent stretch, breakage, and the like based on the loads, twists, bends, and other actions subjected to the cable. Another source of stretch to the cable comes from elastic extension of the cable under load, which is typically characterized as linear in nature. Permanent elongation can occur when high loads on the cable produce uniform plastic yielding. Additionally, localized plastic yielding may occur after a maximum breaking load is exceeded. When the cable is moved in the well, frictional forces also act on the cable and can add to the line tension especially during recovery.

Many cables have helically wound lines that generate torque when under axial load. The cables therefore tend to unlay or untwist to some extent under certain circumstances. Factors surrounding this behavior can be very difficult to predict. Even thermal expansion can occur during use of the cable, although thermal effects may not alter the mechanical properties of the cable's composition.

With all of the forms of elongation, twisting, plastic deformation, etc. that a cable can encounter, the service history of the cable needs to monitored and logged to determine what loads and actions the cable has been subjected to so an assessment can be made whether the cable is still serviceable or not. Additionally, operators need to monitor and tabulate the length of the cable to know where tools are actually located in the well and to perform various operations downhole with the cable.

Although there are many types of downhole cables known in the art and even though they may be effective, operators are continually increasing other types of uses for downhole cables and subjecting the cables to ever changing conditions and environments. To that end, the subject matter of the present disclosure is directed to overcoming, or at least reducing the effects of, one or more of the problems set forth above.

SUMMARY OF THE DISCLOSURE

In one embodiment, a cable is used for running a load between surface and downhole of a well and for communicating with an electrical source between surface and downhole of the well. The cable comprises at least one core element disposed along a length of the cable and composed of carbon nano-tube material. The at least one core element can be a first core element acting as at least one of (i) a load-bearing member bearing the load and (ii) a conductor conducting with the electrical source between surface and downhole. Alternatively, the first core element can act as both (i) a load-bearing member bearing the load and (ii) a conductor conducting with the electrical source between surface and downhole.

The cable with the first core element can have a second core element disposed along the length of the cable and composed of carbon nano-tube material, which can be same or different material than used for the first core element. The second core element can act as only a load-bearing member or as only a conductor. Of course, the second core element can act as both in other embodiments.

The cable can have a jacket disposed externally about the at least one core element and forming an exterior of the cable. The jacket can be an insulator composed of an electrically insulating material. The at least one core element can include at least one wire or a plurality of wires conductively isolated from one another by an insulator of electrically insulating material. In this instance, the cable can have a jacket disposed externally about the insulator and can form an exterior of the cable, and the jacket can be composed of a different material than the wires and the insulator.

In one particular embodiment, the cable can have one or more wires for a first core element and can have an insulator of insulating material disposed thereabout. The cable can further have a second core element disposed about the insulator. This second core element can be composed of carbon nano-tube material, which can be the same or different than used for the one or more wires of the first core element. The second core element can be a plurality of carbon nano-tube wires formed as an external sheath for the cable. Accordingly, the second core element of carbon nano-tube material can act as a load-bearing member and/or a conductor for the cable.

The cable can have a termination disposed at one end of the continuous length of the at least one core element. In general, the termination can use a cablehead defining a preconfigured weakpoint, a rope socket having a mechanical component mechanically engaging the at least one core element and a conductive component electrically engaging the at least one core element, or one or more fixtures mechanically engaging the at least one core element and one or more terminals electrically engaging the at least one core element.

In another embodiment, a system is used for a rig having a wellhead or tree at surface of a well. The system includes a cable and a deployment unit. The cable has a first core element disposed along its length and composed of carbon nano-tube material. The first core element of the cable is both (i) a load-bearing member to bear a load between surface and downhole and (ii) a conductor for conducting with an electrical source between surface and downhole.

The deployment unit directs the cable between a cable source and the tree at surface and runs the cable between surface and downhole. The deployment unit can have an arm extending from adjacent the cable source to adjacent a sheave at the tree, and the arm can feed the downhole cable along the arm between the cable source and the sheave. The deployment unit can have a drum as the cable source, and the arm can have a guide thereon guiding the movement of the downhole cable fed along the arm. A stretch simulator can be coupled to the cable to simulate cable stretch for various operations.

In the system, a tool can be disposed on the cable and can deploy in the well as the load. The tool can be selected from the group consisting of a logging tool, a wireline tool, a shifting tool, a pulling tool, and a mechanical jar. In one arrangement, the tool can have a downhole telemetry unit as the electrical source, and the system can have an uphole telemetry unit electrically communicating with the downhole telemetry unit via the at least one wire of the cable. In another arrangement, the tool can have a logging unit detecting at least one characteristic downhole correlated to depth, and the system can have a depth unit disposed at surface and in electrical communication with the logging unit via the core element of the cable.

In the system, at least one sensor can monitor electrical conductivity of the downhole cable under the load and can detect an increase in the conductivity due to strain of the downhole cable reaching an elevated level. Alternatively in the system, a load cell can be disposed downhole on the cable adjacent the load, and the system can have a tension unit disposed at surface and in electrical communication with the load cell via the at least one wire of the cable.

In yet another embodiment, a method is used for running a load and communicating with an electrical source between surface and downhole of a well. The method involves disposing a cable having at least one core element composed of carbon nano-tube material on a cable source on a rig at surface of the well and involves directing the cable between the cable source and a tree of the rig. The method involves running the cable between surface and downhole by both bearing a load between the surface and downhole with each of the at least one core element of the cable and conducting with an electrical source between surface and downhole with each of the at least one core element of the cable.

The foregoing summary is not intended to summarize each potential embodiment or every aspect of the present disclosure.

BRIEF DESCRIPTION OF THE DRAWINGS

FIG. 6B illustrates a cross-sectional view of an alternative arrangement of the disclosed cable having an optional outer sheath, which can be composed of plastic or the like.

DETAILED DESCRIPTION OF THE DISCLOSURE

Figure 1:
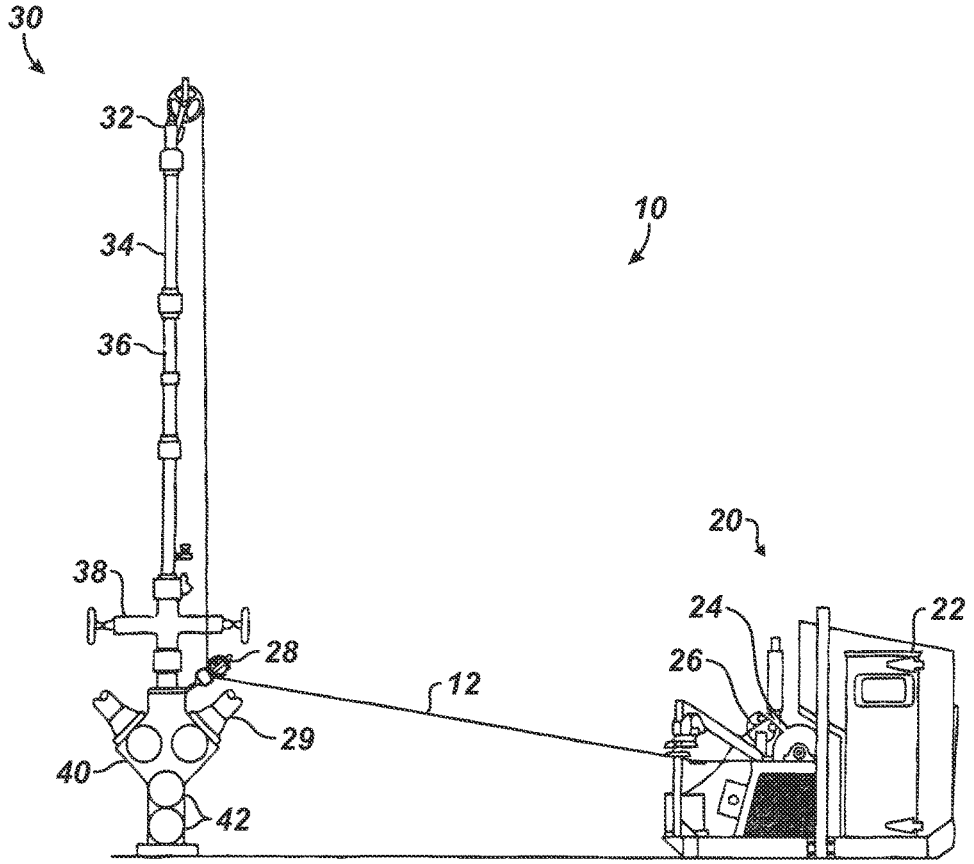
FIG. 1 (Prior Art)
FIG. 1 illustrates a typical rig up system for running cable downhole for various purposes.
Figure 2:
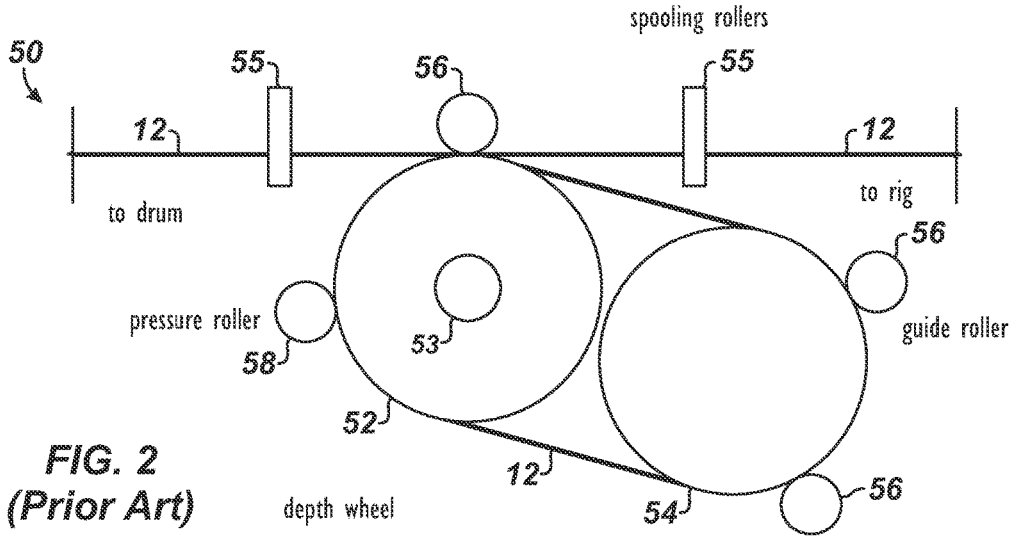
FIG. 2 (Prior Art)
FIG. 2 shows a measuring device that can measure depth and tension for the rig up system.
Figure 3A:
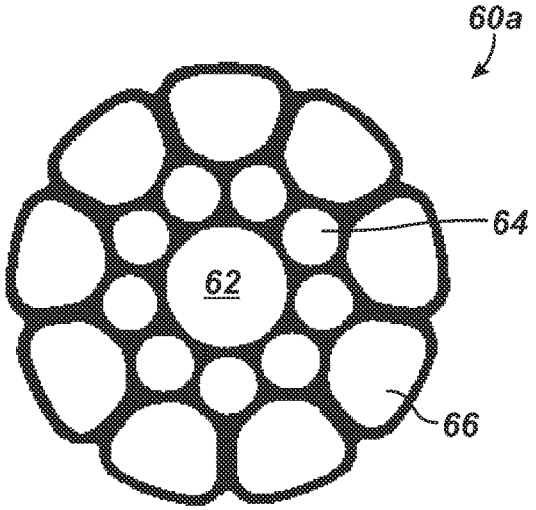
FIG. 3A (Prior Art)
FIG. 3A illustrates a cross-sectional view of a cable according to the prior art.
Figure 3B:
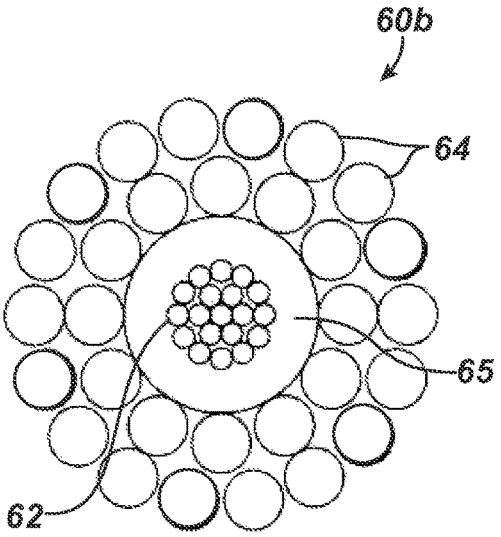
FIG. 3B (Prior Art)
FIG. 3B illustrates a cross-sectional view of a mono-core cased hole cable according to the prior art.
Figure 3C:
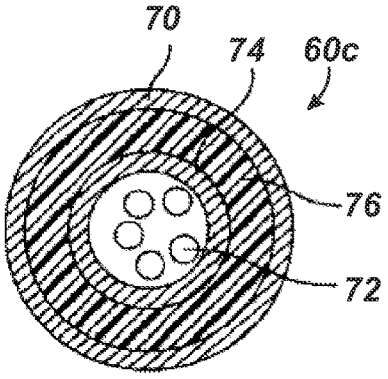
FIG. 3C (Prior Art)
FIG. 3C illustrates a cross-sectional view of a conventional slickline cable according to the prior art.
Figure 3D:
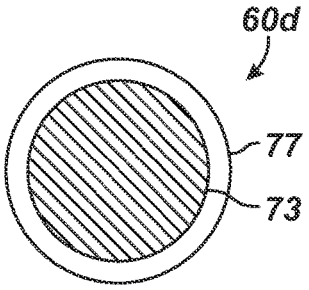
FIG. 3D (Prior Art)
FIG. 3D illustrates a cross-sectional view of a coated slickline according to the prior art.
Figure 3E:
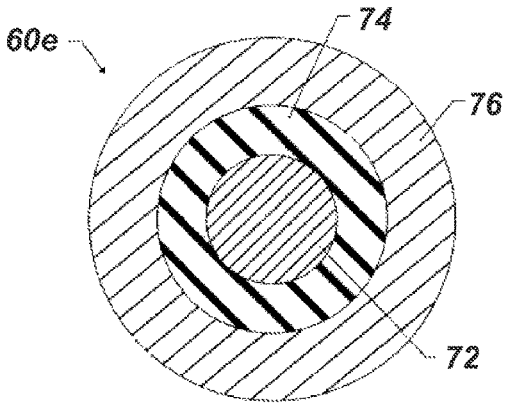
FIG. 3E (Prior Art)
FIG. 3E illustrates a cross-sectional view of another prior art conductive slickline for oilfield use.
Figure 3F:
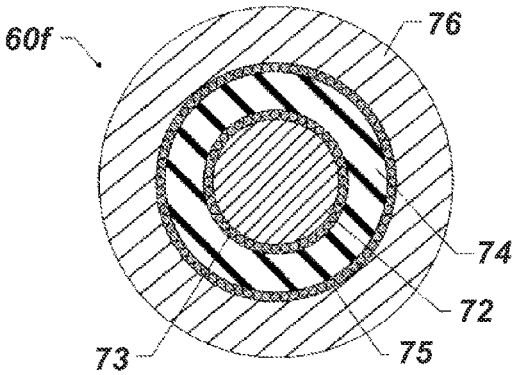
FIG. 3F (Prior Art)
FIG. 3F illustrates a cross-sectional view of an electrical cable according to the prior art having a solid core conductor, a surrounding electrically insulating layer, and a conductive tubular metal outer cover.
Figure 3G:
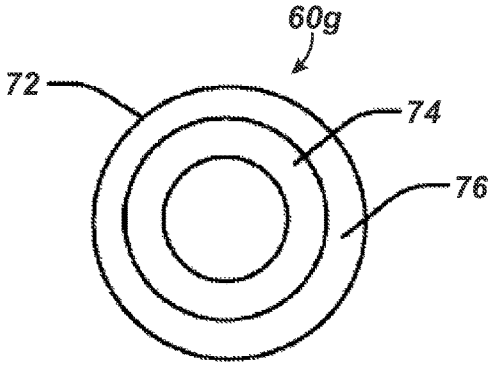
FIG. 3G (Prior Art)
FIG. 3G illustrates a slickline cable according to the prior art having of a solid wire core, an inner coating or jacket, and an outer coating or jacket.
Figure 3H:
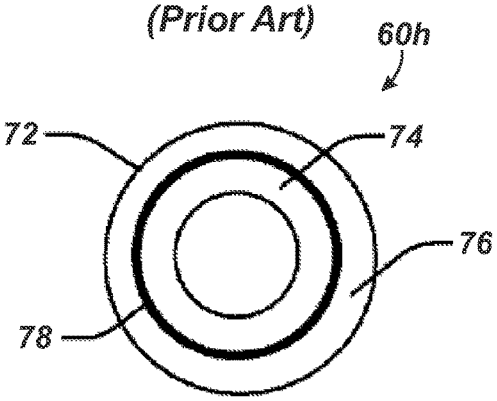
FIG. 3H (Prior Art)
FIG. 3H illustrates a slickline cable according to the prior art having a conductive shield between inner and outer coatings.
Figure 3I:
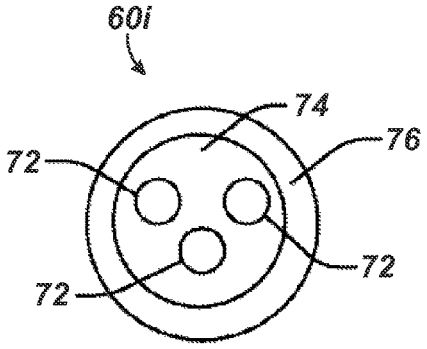
FIG. 3I (Prior Art)
FIG. 3I illustrates a slickline cable according to the prior art having a hard jacketed cable.
Figure 4:
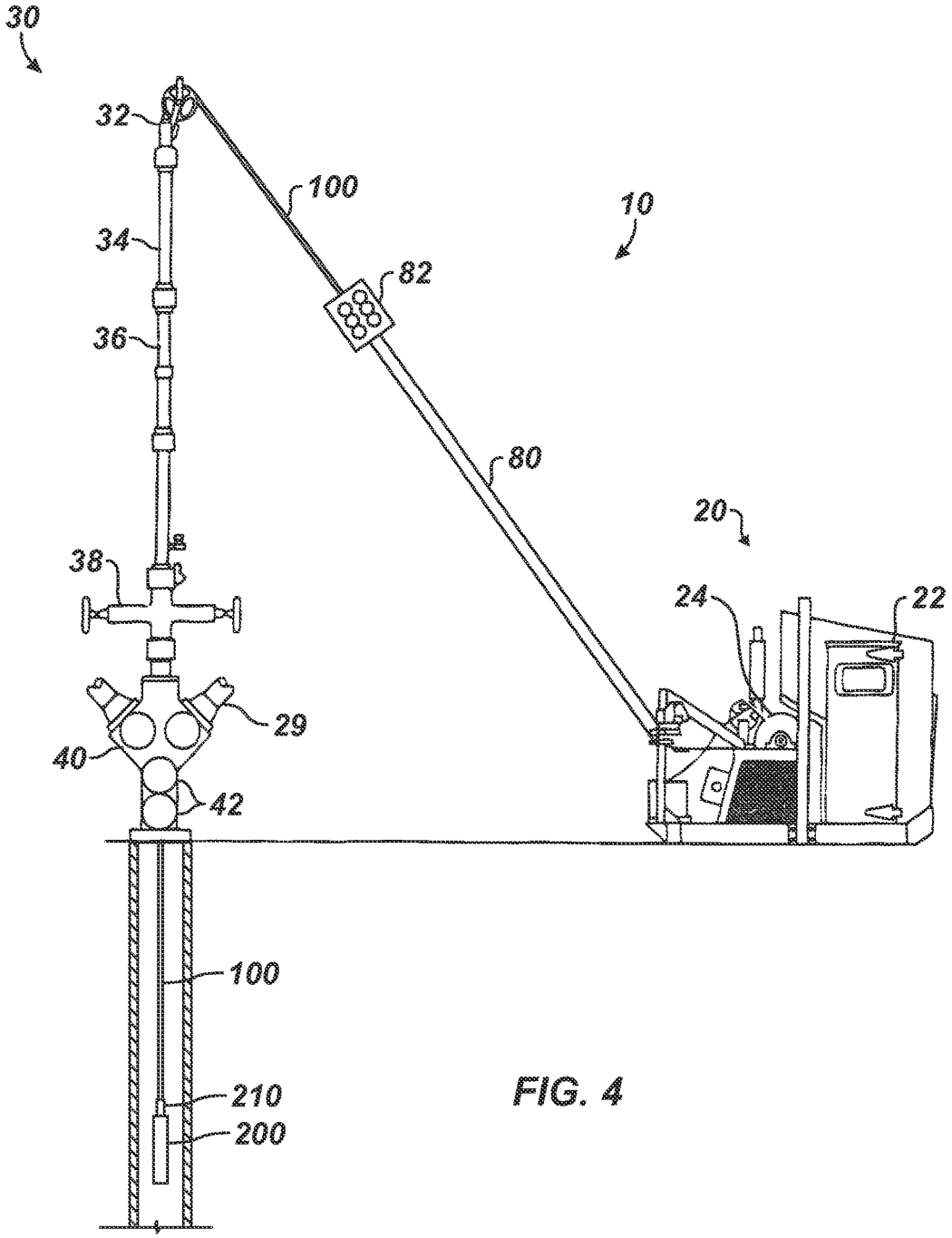
FIG. 4 illustrates a rig up system for running cable of the present disclosure downhole for various purposes.

FIG. 4 illustrates a rig up system 10 for running cable 100 of the present disclosure downhole for various purposes. The cable 100 of the present disclosure has at least one carbon nano-tube core element acting as either one or both of a load-bearing member and a conductor for the cable. Further details of the configuration of the cable 100 are discussed later.

In the rig up system 10, the cable 100 passes from a drum 22 in a deployment unit 20 to an arm 80, which directs the cable 100 to the sheave 32 on the stuffing box 34. The arm 80 can be manipulated using crane components (not shown) or the like to situate the cable 100 more directly from the unit 20 to the Christmas tree 30 and can include a guide unit 82, rollers, goose neck, and the like. The guide unit 82 can also include a conventional system for determining the length of cable 100 paid out and tension on the line.

The cable 100 enters the stuffing box 34 and passes through a lubricator 36 to a secondary barrier 38 or blow out preventer. If desired, a load sensor could be used at the mounting of the sheave 32 to the stuffing box 34. However, the load cell may be used in its conventional location at a winch unit or elsewhere.

Eventually, the cable 100 passes to the Christmas tree 40 through the swab and master valves 42, and then to the well for its intended purposes. Various other components are used with the system 10 as well, but are not described here. When the cable 100 is used for intervention, for example, the rig up system 10 may include cable cutter subs, a tool trap, a tool catcher, check valves, etc.

The cable 100 having the carbon nano-tube core element as the load bearing and conductive member has a smooth, impermeable outer surface so the rig up system 10 can use the stuffing box 34 to pack off around the cable 100. A grease injection system may not be needed, although it could be used when necessary. Additionally, due to the inert nature of the disclosed cable 100, a chemical injection sub 34 for coating corrosive resistant material on the cable 100 may not be used, although it could be used if necessary.

As before, the rig up's deployment unit 20 can be skid-mounted on the rig or can be part of a deployment truck. The unit 20 stores the cable 100 on the drum 24 that feeds the cable 100 in and out of the unit 20. A winch for the drum 24 typically has a hydraulic drive powered by a diesel engine or electric power pack that drives the drum 24 to feed or pull the cable 100. The unit 20 may also include communication, tension, and depth systems.

Figure 5A:
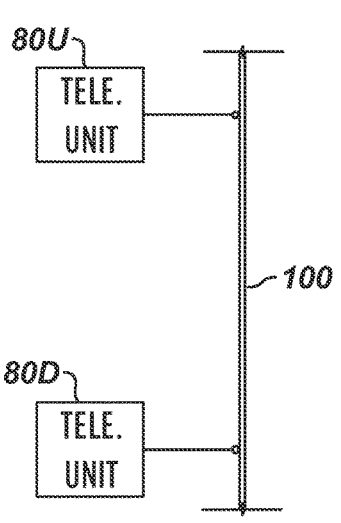
FIG. 5A illustrates a schematic of a communication arrangement for the disclosed cable.

FIG. 5A illustrates a schematic of a communication arrangement for the disclosed cable 100. Uphole and downhole telemetry units 80U-D communicate electrical signals with one another along the cable 100 since the carbon nano-tube wire of the cable 100 is a conductor as well as load bearing. Although not shown, the cable 100 may also conduct electrical power.

Figure 5B:
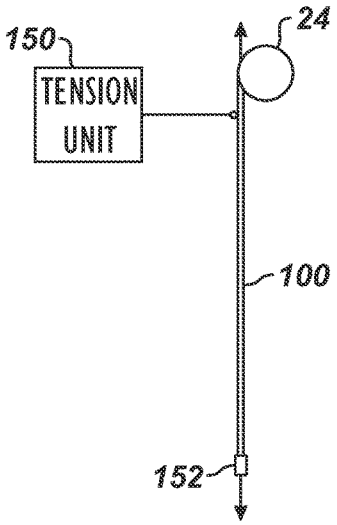
FIG. 5B illustrates a schematic of a tension monitoring arrangement for the disclosed cable.

FIG. 5B illustrates a schematic of a tension monitoring arrangement for the disclosed cable 100. A tension unit 150 disposed at surface with the drum 24 monitors the tension by communicating with a load cell or strain gauge 152 disposed downhole on the cable 100 at or near a downhole tool or cable termination (not shown) on the cable 100. Because the cable's carbon nano-tube wire is both load bearing and conductive, signals from the load cell 152 can readily be communicated to the tension unit 150 at the surface.

Being disposed on the end of the carbon cable 100, the load cell or strain gauge 152 can measure strain directly at the termination. Readings from the cell 152 can then be communicated directly uphole via the cable 100 so operators at the surface can know the actual loads on the cable 100 at a tool (not shown), rather than needing to infer the load at the tool from strain measurements at the surface and characterization of the cable's behavior.

Figure 5C:
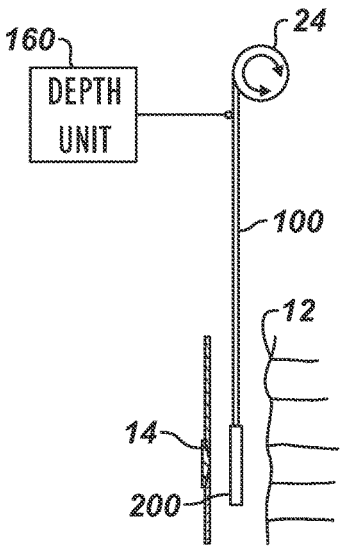
FIG. 5C illustrates a schematic of a depth monitoring arrangement for the disclosed cable.

FIG. 5C illustrates a schematic of a depth monitoring arrangement for the disclosed cable 100. A downhole tool 200, such as a logging unit, detects characteristics of the borehole 12, such as its lithography, transitions, etc., which have been correlated with a depth in the borehole 12. Detected characteristics from the tool 200 are communicated through the cable 100 to the depth unit 160 at the surface. The depth unit 160, in turn, determines the depth of the tool 200 in the borehole 12 and the length of the cable 100 deployed.

In addition to using logging characteristics for depth correlation, other measures could be used. For example, casing collar location and other comparable techniques could also be used to correlate the length of the cable 100 based on the depth of the tool 200. As such, the tool 200 can include a casing collar locator to locate collars 14 in the casing.

Figure 5D:
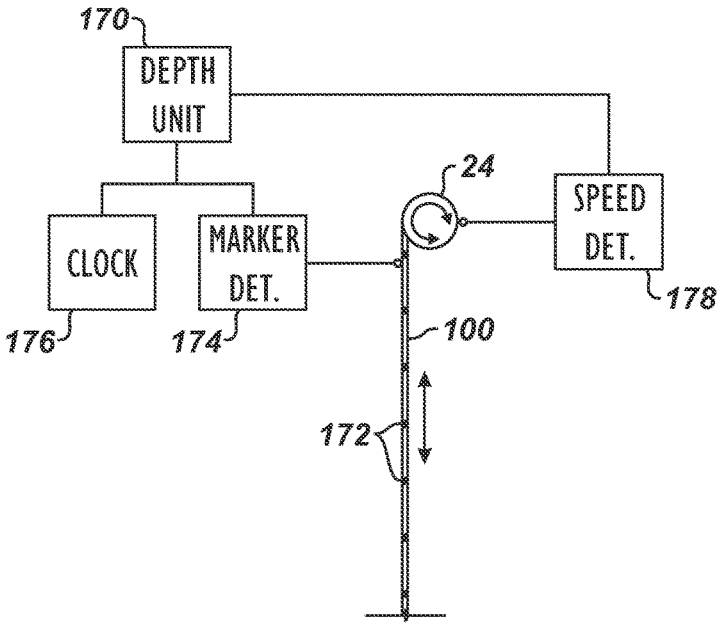
FIG. 5D illustrates a schematic of another depth monitoring arrangement for the disclosed cable.

FIG. 5D illustrates a schematic of another depth monitoring arrangement for the disclosed cable 100. The cable 100 has a plurality of markers 172 disposed along its length at known separations. As will be discussed below, the cable 100 having the carbon nano-tube wire is not subject to extensive elongation during use so the distance between markers 172 can be relatively consistent along the length of the cable 100.

A marker detector 174 reads the markers 172 in the non-metallic cable 100 and infers the depth of any tool deployed thereon. The markers 172 can be metallic elements disposed in the non-metallic cable 100 so the detector 174 can sense a change in magnetic field associated with the passing marker 172. Other forms of detection can be used, including electrical, optical, Radio Frequency Identification, and the like.

A speed detector 178 associated with the drum 24 determines and records the speed of the pay out of the cable 100 using know techniques, and a clock 176 measures a time between signals from the markers 172. Based on the time between signals and the spooling speed of the cable 100, a depth unit 170 can determine the length of the cable 100 paid out, which can infer the depth of any tool on the cable 100 in the borehole.

Depth determination and control with a conventional cable is difficult because the cable tends to stretch substantially. Additionally, wire slippage is common in slickline operations. Here, the stretch of the disclosed cable 100 can be as low as less than 1-ft per 1000-ft downhole so depth downhole can be determined rather directly without much accounting for stretch and variation along the length of the disclosed cable 100. Embodiments of devices for determining depth are disclosed in co-pending PCT application entitled "Downhole Running Cable Depth Measurement" by Bradley J. McFarland, Andrew J. Baker, and George J. Rodger, which is filed herewith and is incorporated herein by reference in its entirety.

Having a general understanding of the disclosed cable 100 with the carbon nano-tube wire for load bearing and conducting, discussion now turns to particular constructions of the disclosed cable 100 and the arrangement of non-metallic, carbon nano-tube core elements making up its load bearing and conductive elements.

Figure 6A:
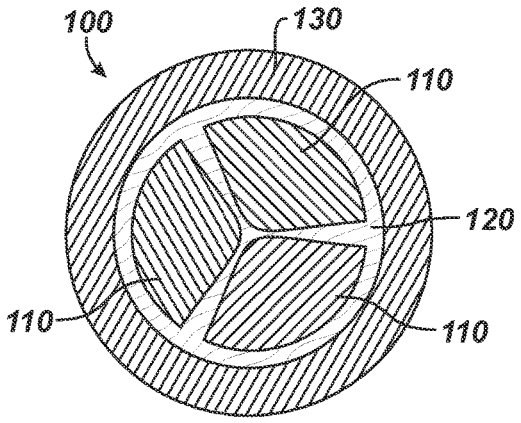
FIG. 6A illustrates a cross-sectional view of a non-metallic cable according to the present disclosure for use as slickline, electric wireline (e-line), braided line, Heavy Duty Wireline Fishing (HDWF) line, or the like for downhole applications in a well.

FIG. 6A illustrates a non-metallic cable 100 according to the present disclosure for use as a slickline, an electric wireline (e-line), a braided line, a Heavy Duty Wireline Fishing (HDWF) line, or the like for downhole applications in a well. The cable 100 uses carbon nano-tube wire 110 as at least one core element acting as the load bearing member and as the conductor for the cable 100. In the sense used herein, a load-bearing member at least describes the component or components of the disclosed cable 100 that collectively carry the bulk of the tensile load to which the cable 100 is subjected due to weight of a tool, pulling action, jarring, etc. As discussed previously, the cable 100 can be used for depth correlations and can pass signals or power. Thus, a conductor as used here in at least describes a component or components of the cable for conducting electrical power, signals, telemetry, etc.

In the depicted arrangement, the cable 100 includes three carbon nano-tube wires 110 insulated by an insulator of insulating material 120. In general, the cable 100 can have one or more carbon nano-tube wires 110, and three are shown merely for illustration. The insulating material for the insulator 120 can be PEEK, nylon, or other suitable material for electrical isolation and flexibility.

The carbon nano-tube wires 110 can be profiled as shown to form a more circular cross-section to the cable 100 when positioned together, although this is not strictly necessary as any shape can be used. For example, the wires 110 can have a conventional circular cross-section and can still fit together into a cable having a circular cross-section. However, because the carbon nano-tube wires 110 are formed differently than conventional wires, they can be more readily formed with profiled shapes so that when fit together the wires 110 give more cross-sectional wire area inside a set diameter of the resulting cable 100.

The cable 100 also includes a jacket armor 130 of carbon nano-tube material that is the same or different than that used for the wires 110. This jacket armor 130 preferably forms a smooth outer surface so the cable 100 can be used without the need for a grease injection system. For example, the smooth outer surface can be formed by a braiding or weave of carbon nano-tube wire for the jacket armor 130 around the inner insulation material 120 and inner wires 110.

One particular source of carbon nano-tube material is CurTran LLC of Houston, Tex. The inner load and conductor wires 110 can be formed as continuous strands from carbon nano-tube in a wire forming process. In general, the wire forming process produces filaments, which are then processed to form the desired wire size. Run together to form the core of the final cable 100, the wires 110 are extruded with the insulation material 120. Finally, the jacket armor 130 is braided, woven, wound, or otherwise formed around the outside of the insulated core for the disclosed cable 100.

As noted here in, the carbon nano-tube wire 110 is a non-metallic conductor and load bearing member for the cable 100. Compared to other conductors and load bearing wires, the carbon nano-tube wire 110 for the disclosed cable 100 has a number of advantages. For conductivity, the wire 110 has low resistance, making it a good conductor of electricity, and the wire 110 has low impedance, which can reduce power losses. The wire 110 can also be well-suited for signal transmission and reduced noise.

As to mechanical properties, the wire 110 is light-weight and has a low coefficient of thermal expansion (CTE), and the wire 110 is composed of a non-corrosive and inert material for use in harsh environments, such as a wellbore. Additionally, the wire 110 has high-strength and is not subject to the same issues of fatigue as other wires.

As noted herein, the cable 100 conveys tools and equipment into and out of a wellbore. To do this, the cable 100 has the non-metallic wire 110 as the principal load bearing member. Moreover, the load-bearing member can also be a conductor for the cable 100. Accordingly, the conductors and the load bearing members 110 of the cable 100 are one and the same and, hence, have the same tensile strength and conductivity, unlike the conventional cables whose copper conductor is different in tensile strength than the steal wires.

In general, the cable 100 can have one or more load bearing members and in turn can have one or more conductors. In one embodiment, one of the load bearing members is the external jacket armor 130, which can also be a conductor if desired. Additionally, electrical current can be passed through the load-bearing conductor(s) 110. In this way, electrical signals can be sent from surface to control downhole devices coupled to the cable 100. Likewise, electrical signals can be sent from downhole to surface to transfer information.

Typical sizes of the cable 100 can be comparable to those sizes used in conventional applications, although the cable 100 in general can be smaller for the same application. The cable 100 can be of any desired length, such as 25,000-ft. Rather than being just a material reinforced with carbon nano-tubes, the disclosed cable 100 is continuous, and the load bearing wires 110 are composed almost entirely of carbon, except for the small amount of void space.

During loading, the cable 100 stays in the elastic region so the cable 100 does not suffer from some of the restrictions of conventional cables, such as bend restrictions, etc. Therefore, the disclosed cable 100 can use tighter bend radii, drums, smaller sheaves, etc., during deployment and use.

Because conventional cables can fatigue, their use needs to be logged. However, the disclosed cable does not suffer from such fatigue. The demands for monitoring the disclosed cable 100 are less rigorous.

It is possible for the disclosed cable 100 to fail, however. This can be detected using the electrical properties of the disclosed cable 100. When the cable 100 is subjected to loads, for example, the breaking level of the disclosed cable 100 may be reached or surpassed depending on operations and circumstances. As the disclosed cable 100 reaches its maximum load, the electrical conductivity of the cable 100 increases. This is due in part to the further compaction of the void space in the carbon nano-tube structure of the wire 110 when subjected to increased load.

By monitoring the electrical conductivity of the cable 100 during use, sensors at surface or elsewhere can detect the increase in conductivity should the cable 100 begin to reach its breaking point. For example, a sensor electrically connected to the cable 100 at the deployment unit (20) can sense the conduct of the cable 100 in a number of ways. Such a sensor can include an electronic circuit to detect current, voltage, etc. of a signal communicated through the load-bearing member of the cable 100 so the conductivity can be determined. If a threshold is reached, the deployment unit (20) can then automatically stop operations. Overall, the disclosed cable 100 can be operated at levels closer to its breaking strain because the cable 100 does not fatigue in the same way as a conventional metallic cable.

Figure 6B:
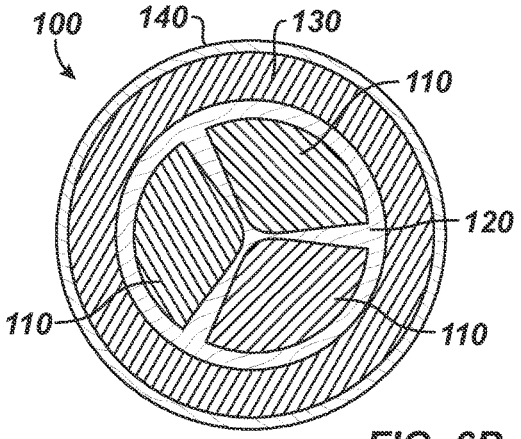

FIG. 6B shows an alternative arrangement of the disclosed cable 100 having an optional outer sheath 140, which can be composed of plastic or the like. Such an outer sheath 140 may be unnecessary in most cases because the jacket armor 130 of carbon nano-tube wire on the disclosed cable 100 is practically impermeable.

Figure 6C:
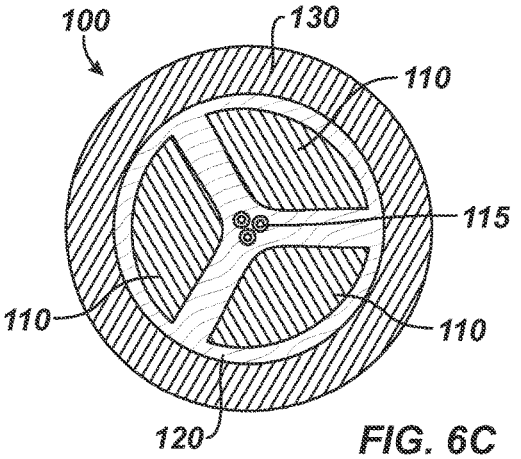
FIG. 6C illustrates a cross-sectional view of yet another arrangement of the disclosed cable having fiber optic cables disposed in the cable, for example, inside or near a grouping of the carbon nano-tube wires.

FIG. 6C shows yet another arrangement of the disclosed cable 100 having fiber optic cables 115 disposed in the cable 100, for example, inside or near the grouping of the nano-tube wires 110. The fiber optic cables 115 can be used to send signals to tools downhole.

Figure 6D:
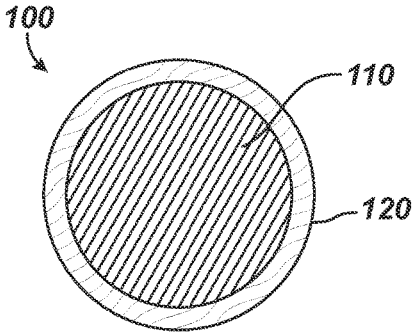
FIGS. 6D to 6J illustrate cross-sectional views of yet additional arrangements of the disclosed cable.
Figure 6E:
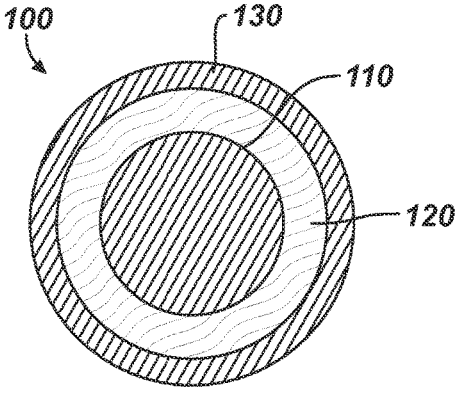
Figure 6F:
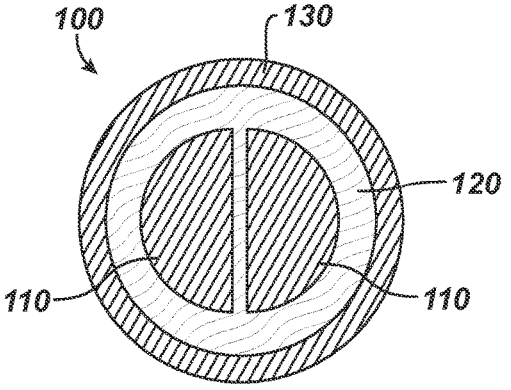

FIGS. 6D to 6F illustrate cross-sectional views of yet additional arrangements of the disclosed cable 100. In FIG. 6D, the cable 100 includes a single load bearing member/conductor in the form of a carbon nano-tube wire 110. This may be surrounded by an outer insulator or sheathing 120.

Figure 6G:
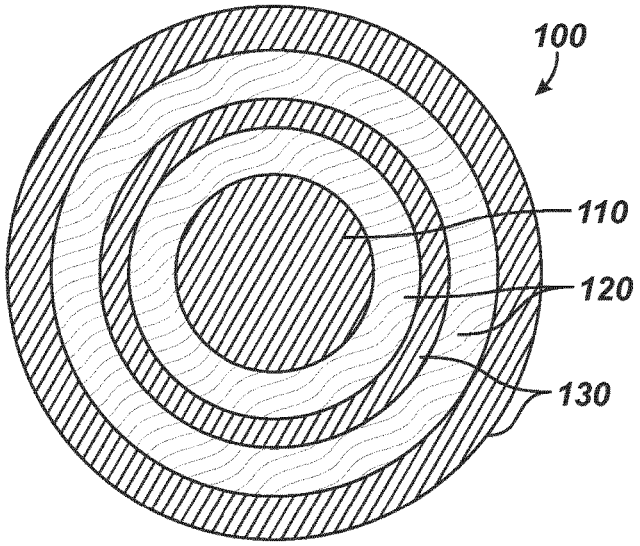

The cable 100 in FIG. 6E is similar and includes a central load-bearing/conductor member in the form of a carbon nano-tube wire 100. The cable 100 in FIG. 6F is similar and includes two central wires 110. In both cases, a jacket armor 130 of carbon nano-tube wire 130 can be disposed about intermediate insulating material 120. This jacket armor 130 can also be a load bearing member and/or conductor according to the purposes disclosed herein. As shown in FIG. 6G, additional layers of insulation 120 and jacket armor 130 can also be formed about the wires 110 and layers depicted in FIGS. 6E-6F to create cables 100 with ever increasing diameters and additional load bearing members and conductors.

Figure 6H:
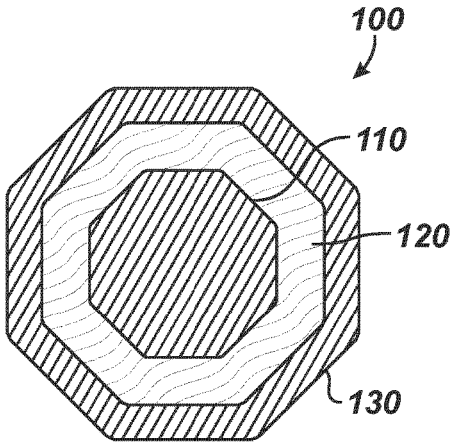
Figure 6J:
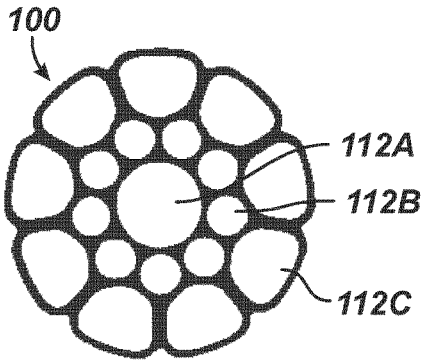

The cables 100 depicted above have been circular in cross-section because this is the typical configuration and may be the most convenient. This is not strictly necessary. For example, FIG. 6H shows a cross-section of a cable 100 having a multisided cross-section. Moreover, FIG. 6I even shows a cable 100 having a flattened cross-section. Multiple inner wires 110 are disposed side-by-side one another and are encased in insulating material 120. An outer jacket armor 130 can also be provided that is formed of carbon nano-tube. FIG. 6J illustrates a cable 100 having various wires 112A-C with at least some wires (e.g., 112C) having different cross-sections from other wires (e.g., 112B). In another alternative, FIG. 6J shows how one wire 112A as one core element can be separated by an insulator 112B surrounded by a second core element of a plurality of carbon nano-tube wires 112C formed as a sheath about the insulator 112B.

Figure 6I:
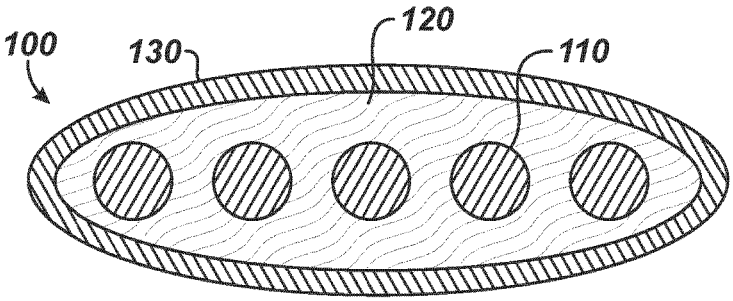

Such alternative shapes for the cable 100 as in FIGS. 6H-6I can have a number of advantages for particular implementations. For example, the multisided cable 100 of FIG. 6H may have particular sealing advantages as it is run through a stuffing box or the like. The flattened cable 100 of FIG. 6I can be wound on a reel and potentially take up less space, and the cable 100 could be deployed and situated downhole to take up less cross-sectional area, potentially increasing flow or passage of tools.

Figure 7A:
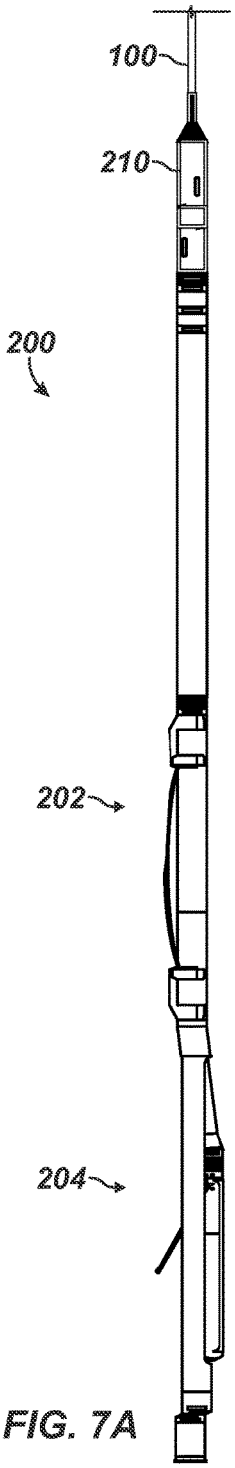
FIGS. 7A-7B illustrate exemplary toolstrings for deployment downhole on the cable to perform some type of operation.
Figure 7B:
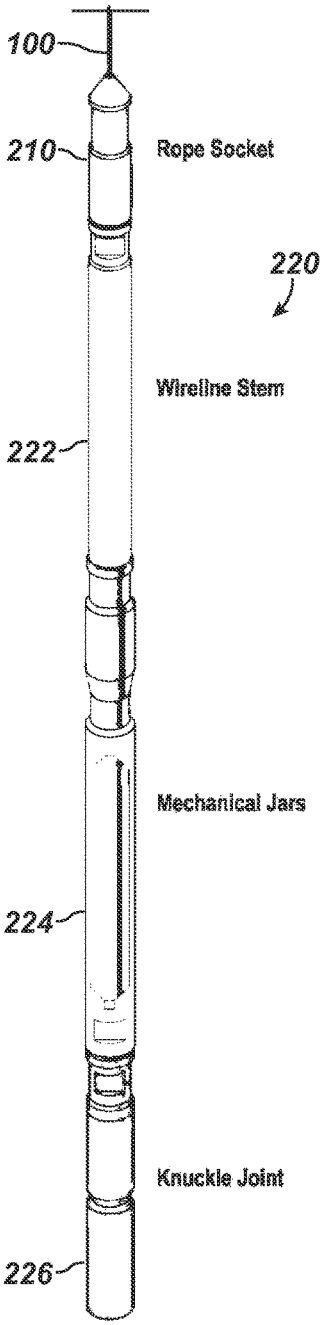

Turning now to the cable's termination, the end of the cable 100 is used downhole for various purposes and may holding a logging tool, wireline tool, shifting tool, pulling tool, etc. The end of the cable 100 is therefore terminated to connect the cable 100 to such downhole tools or components. FIGS. 7A-7B show examples of some of the components that can be supported on the end of the cable 100.

FIG. 7A shows an exemplary toolstring 200 for deployment downhole on the cable 100 to perform some type of operation. In slickline work, the string 200 is run, manipulated, and retrieved by the upward or downward movement of the cable 100, which is itself raised and lowered by the winch and other components at the surface.

A cable termination 210 connects to the cable 100 to the toolstring 200. For its part, the toolstring 200 can have any number of basic components 202, 204, etc. according to the type of operation undertaken, and the precise configuration of the toolstring 200 is contingent on factors such as job type, access, hole deviation, depth pressure, completion type, log history, etc.

FIG. 7B shows another exemplary tool string 220 for deployment on the cable 100. This tool string 220 is a workstring having a wireline stem 212, mechanical jars 224, and a knuckle joint 226 for performing slickline operations. Other forms of workstrings can be used with the cable 100.

As noted above, the end of the cable 100 is terminated with a cablehead 210, which connects to tools for the intended proposes in the well. The termination 210 provides three basic functions, including mechanical/electrical connection, a fish-neck for retrieval, and a preconfigured weak-point. The termination 210 incorporates a fishing neck at its top end. This allows a fishing tool to latch on to a stuck or dropped toolstring to fish it from the well.

Figure 8A:
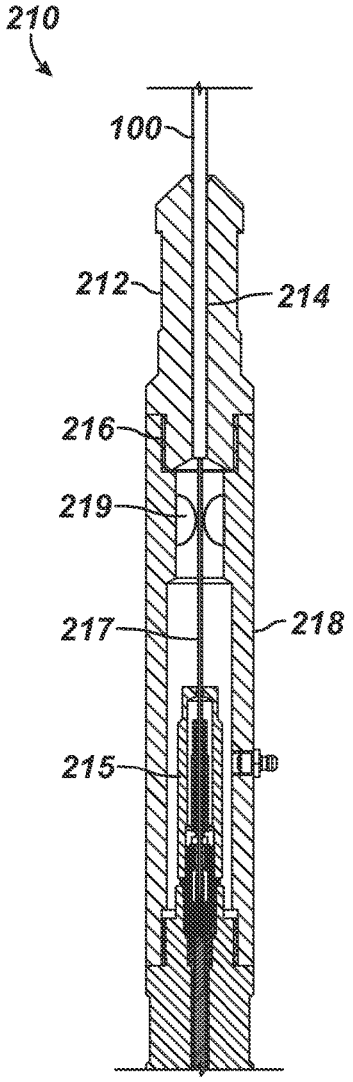
FIG. 8 illustrates a cross-sectional view of a cable termination using a threaded rope socket.

In one embodiment, the cable termination 210 uses a threaded rope socket as shown in FIG. 8A. A portion at the end of the cable 100 is attached or affixed at 214 to a fishneck 212 using a variety of techniques. A threaded end 216 of the fishneck 212 threads into a rope socket 214, and a conductive or transmissive component 217 of the affixation (or of the cable 100 itself) connects to internal components 215 of the rope socket 218 for establishing an electrical, optical, communicative, or other type of connection. This conductive or transmissive component 217 may have a backup mechanical connection (not shown) inside the socket 218.

Figure 8B:
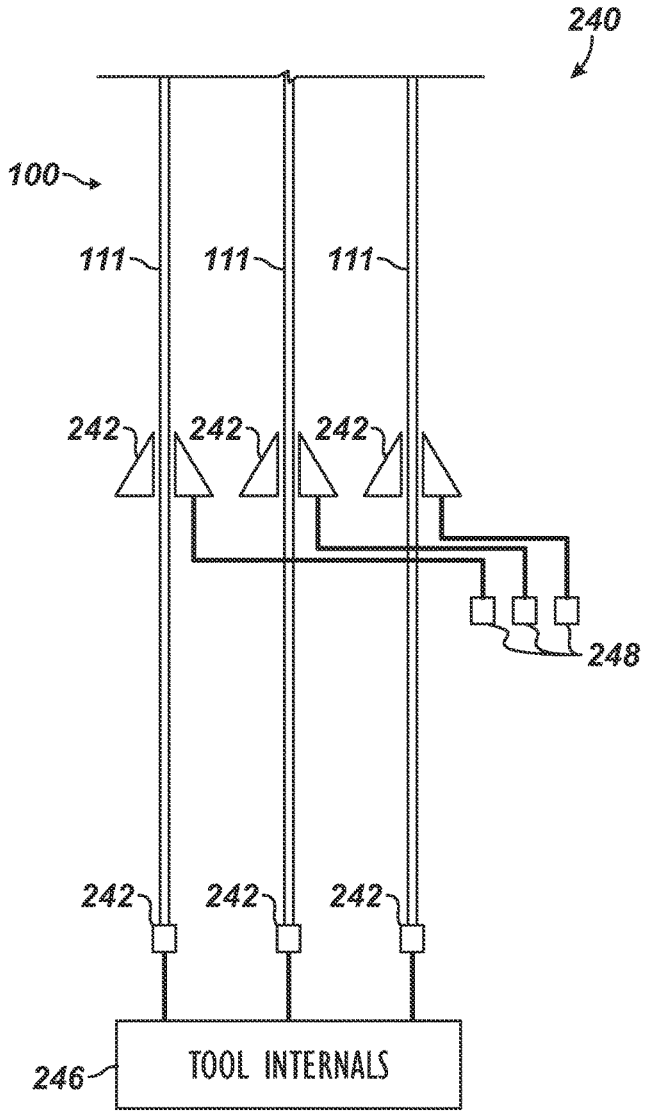

Another cable termination 240 is schematically shown in FIG. 8B. The multiple wires 111 of the cable 100 (if present) branch off from one another either side-by-side as shown or inside and outside one another in a concentric arrangement. These wires 110 can be the internal wires (e.g., 110: FIGS. 6A-6I) and can also be the outer jackets (e.g., 130: FIGS. 6A-6I). Mechanical fixtures 242 engage the wires 111 to mechanically support the cable 100. The fixtures 242 can include slips or the like.

Terminals 244 at the end of the wires 111 then connect by electrical lines to the tool's internal components 246. Secondary electrical connections can also be provided via the mechanical fixtures 242, which can connect by electrical lines to terminals 248 for appropriate connection to the tool's internal components 246.

In addition to the above, a slickline rope socket 210 and several other terminations and cableheads can be used, including a pear drop rope socket, a knot type rope socket, a releasable rope socket, and a braided line rope socket.

Figure 9A:
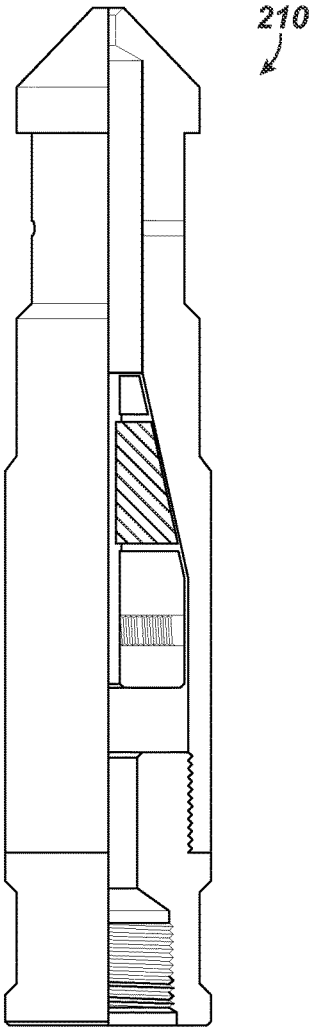
FIGS. 9A-9C illustrate various other cable terminations that can be used with the disclosed cable.

For example, the termination shown in FIG. 9A can be similar to a braided line rope socket 210 having a slip assembly—e.g., a cone and a washer system. The specially designed slip assembly secures the wire (not shown) to the rope socket 210, and line tension increases the grip of the rope socket 210 to the wire.

Figure 9B:
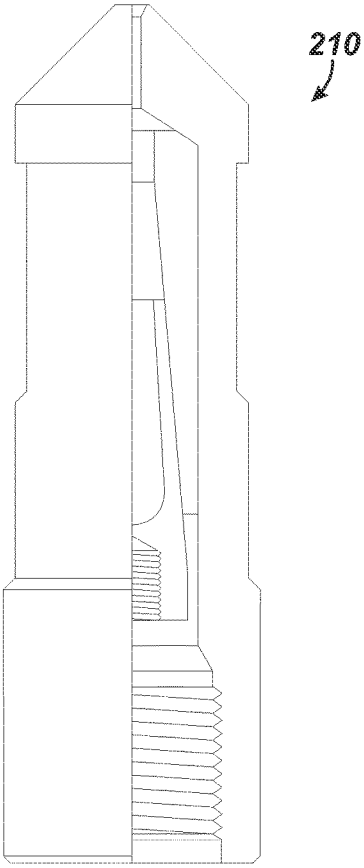

In the pear drop rope socket 210 shown in FIG. 9B, the wire is wrapped around a groove in a pear drop and is wedged in a taper between the tear drop and a mating sleeve. This wedge action grips the wire (not shown) and is proportional to the tension applied to the wire.

Figure 9C:
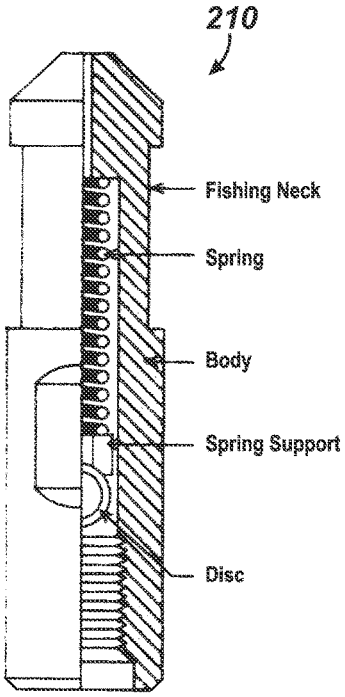

In the knot type rope socket 210 shown in FIG. 9C, a traditional slickline knot is used, and the knot can be tied to allow the rope socket 210 to break at a predetermined pull. The knot type rope socket 210 consists of a body, a spring, a spring support, and a disc. The wire (not shown) is bent around the disc then wound around itself a number of turns dependent upon the required weak point value required.

Such a releasable rope socket 210 can be used for either slick or braided type slickline and is designed to release only in the event that the toolstring becomes stuck downhole. The socket 210 is activated by a drop bar which is dropped down the cable (not shown) in a similar manner to a go-devil or snipper. When the drop bar contacts the release trigger, the collet releases the lower fishing neck. The upper housing and drop bar are retrieved to surface leaving a clean fishing neck.

The braided line rope socket 210 can be an overload type or a plain type of socket. The overload type is designed to release by causing the line to break under severe loading at a specific percentage of the full strength of the line. The plain type is designed without the overload release feature.

Because the disclosed cable 100 has such limited stretch, deployment and use of the cable 100 in some implementations may use stretch simulators or accelerators to facilitate operations. The stretch simulator or accelerator can be installed on a toolstring (200, 220) immediately below the rope socket (210). The accelerator can be installed primarily when spring/hydraulic jars are to be used on the workstring (220). The spring replaces the 'stretch' of the cable 100 which exists when jarring up. The accelerator reduces the shock-loading at the rope socket 210 and can cause the stem to 'accelerate' faster when the spring/hydraulic jars go off. This creates a more effective impact.

Figure 10:
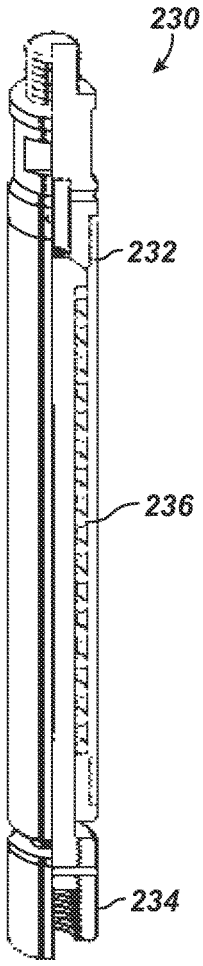
FIG. 10 illustrates a stretch simulator or accelerator for installing on a toolstring immediately below a rope socket for the disclosed cable.

As shown in FIG. 10, for example, a stretch simulator or accelerator 230 has a top section 232, a bottom section 234, and a spring or beveled washers 236 between them. The accelerator 230 works by the cable (100) pulling on the top section 232 while the bottom section 234 is held by a pulling tool (not shown). The beveled washers 236 are compressed, and as the jar (224) below fires, the beveled washers 236 expand which in turn accelerates the toolstring giving more impact.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

The invention claimed is:

1. A cable system for running a load between surface and downhole of a well and for communicating with an electrical source between surface and downhole of the well, the cable system comprising:

a cable having at least one core element disposed along a length of the cable, the at least one core element being composed of carbon nano-tube material and acting as at least one of (i) a load-bearing member bearing the load and (ii) a conductor conducting with the electrical source;

a deployment unit directing the cable between a cable source and the well at surface and running the cable between surface and downhole; and at least one sensor monitoring electrical conductivity of the at least one core element under the load and detecting an increase in the conductivity due to strain of the downhole cable reaching an elevated level.

2. The cable system of claim 1, wherein the at least one core element comprises a first core element of the cable disposed along the length of the cable and composed of the carbon nano-tube material, the first core element acting as at least one of (i) the load-bearing member bearing the load and (ii) the conductor conducting with the electrical source.

3. The cable system of claim 2, wherein the cable comprises a second core element disposed along the length of the cable and composed of carbon nano-tube material, the second core element acting as only a load-bearing member, as only a conductor, or both a load-bearing member and a conductor of the cable.

4. The cable system of claim 2, wherein the first core element comprises at least one wire of the carbon nano-tube material; and wherein the cable comprises an insulator composed of electrically insulating material and disposed externally about the at least one wire.

5. The cable system of claim 4, wherein the cable comprises a jacket disposed externally about the insulator and forming an exterior of the cable, the jacket composed of a different material than the at least one wire and the insulator.

6. The cable system of claim 4, wherein the cable comprises a second core element disposed externally about the insulator along the length of the cable, the second core element composed of carbon nano-tube material.

7. The cable system of claim 6, wherein the second core element comprises a plurality of carbon nano-tube wires formed as a sheath about the insulator.

8. The cable system of claim 6, wherein the second core element acts as at least one of a load-bearing member and a conductor for the cable.

9. The cable system of claim 6, wherein the second core element forms an exterior of the cable; or wherein the cable comprises a jacket disposed about the second core element and forming the exterior of the cable.

10. The cable system of claim 2, wherein the first core element comprises a plurality of wires conductively isolated from one another by an insulator.

11. The cable system of claim 10, further comprising one or more fiber optic cables disposed with the wires in the insulator.

12. The cable system of claim 10, wherein at least some of the wires comprise different cross-sections from one another.

13. The cable system of claim 1, wherein the cable has a non-circular cross-section.

14. The cable system of claim 1, further comprising a tool disposed on the cable and deploying in the well as the load.

15. The cable system of claim 14, wherein the tool is selected from the group consisting of a logging tool, a wireline tool, a shifting tool, a pulling tool, and a mechanical jar.

16. The cable system of claim 14, wherein the tool comprises a downhole telemetry unit as the electrical source, and wherein the system comprises an uphole telemetry unit electrically communicating with the downhole telemetry unit via the at least one core element of the cable.

17. The cable system of claim 14, the cable system comprising:

a stretch simulator coupled between the cable and the tool.

18. The cable system of claim 14, wherein the tool is disposed at a termination of the cable, the termination comprising:

a cablehead defining a preconfigured weakpoint;

a rope socket having a mechanical component mechanically engaging the first core element and a conductive component electrically engaging the first core element; or one or more fixtures mechanically engaging the first core element and one or more terminals electrically engaging the first core element.

19. The cable system of claim 14, wherein the tool comprises a logging unit detecting at least one characteristic downhole correlated to depth, and wherein the system comprises a depth unit disposed at surface and in electrical communication with the logging unit via the at least one core element of the cable.

20. The cable system of claim 1, wherein the deployment unit comprises an arm extending from adjacent the cable source to adjacent a sheave at the well, the arm feeding the cable along the arm between the cable source and the sheave.

21. The cable system of claim 20, wherein the deployment unit comprises a drum as the cable source.

22. The cable system of claim 20, wherein the arm comprises a guide thereon guiding the movement of the downhole cable fed along the arm.

23. The cable system of claim 20, wherein the arm is manipulatable to situate the cable directly from the source to the sheave.

24. The cable system of claim 20, wherein the deployment unit comprises a drum as the cable source, and wherein the arm comprises a guide thereon guiding the movement of the downhole cable fed along the arm.

25. The cable system of claim 1, wherein the at least one core element acts at least as the load-bearing member of the cable; and wherein the deployment unit monitors the conductivity of the load-bearing member and automatically stops operation in response to the strain reaching the elevated level of a breaking point of the load-bearing member.

26. The cable system of claim 1, wherein the at least one sensor comprises an electronic circuit detecting current or voltage of a signal communicated through the load-bearing member of the cable.

27. A cable system for running a load between surface and downhole of a well and for communicating with an electrical source between surface and downhole of the well, the cable system comprising:

a cable having at least one core element disposed along a length of the cable, the at least one core element being composed of carbon nano-tube material and acting as at least one of (i) a load-bearing member bearing the load and (ii) a conductor conducting with the electrical source;

a deployment unit directing the cable between a cable source and the well at surface and running the cable between surface and downhole;

a load cell disposed downhole on the cable adjacent the load; and a tension unit disposed at surface and in electrical communication with the load cell via the at least one core element of the cable.

28. The cable system of claim 27, wherein the deployment unit comprises an arm extending from adjacent the cable source to adjacent a sheave at the well, the arm feeding the cable along the arm between the cable source and the sheave.

29. The cable system of claim 28, wherein the deployment unit comprises a drum as the cable source, and wherein the arm comprises a guide thereon guiding the movement of the downhole cable fed along the arm.

30. The cable system of claim 28, wherein the arm is manipulatable to situate the cable directly from the source to the sheave.

31. The cable system of claim 27, further comprising a tool disposed on the cable and deploying in the well as the load.

32. The cable system of claim 31, wherein the tool is disposed at a termination of the cable; and wherein the termination comprises:

a cablehead defining a preconfigured weakpoint;

a rope socket having a mechanical component mechanically engaging the at least one core element and a conductive component electrically engaging the at least one core element; or one or more fixtures mechanically engaging the at least one core element and one or more terminals electrically engaging the at least one core element.

33. The cable system of claim 31, wherein the tool comprises a downhole telemetry unit as the electrical source, and wherein the system comprises an uphole telemetry unit electrically communicating with the downhole telemetry unit via the at least one wire of the cable.

34. The cable system of claim 31, wherein the tool comprises a logging unit detecting at least one characteristic downhole correlated to depth, and wherein the system comprises a depth unit disposed at surface and in electrical communication with the logging unit via the at least one core element of the cable.

35. The cable system of claim 31, wherein the tool is selected from the group consisting of a logging tool, a wireline tool, a shifting tool, a pulling tool, and a mechanical jar.

36. The cable system of claim 27, wherein the at least one core element comprises a first core element of the cable disposed along the length of the cable and composed of carbon nano-tube material, the first core element acting as at least one of (i) the load-bearing member bearing the load and (ii) the conductor conducting with the electrical source.

37. The cable system of claim 36, wherein the cable comprises a second core element disposed along the length of the cable and composed of carbon nano-tube material, the second core element being electrically insulated from the first core element and being only a load-bearing member of the cable, only a conductor of the cable, or both a load-bearing member and a conductor of the cable.

38. The cable system of claim 27, wherein the tension unit receives a reading communicated directly from the load cell measuring strain and determines a value of the load directly from the measured strain.

* * * * *